US008122733B2

(12) United States Patent
Raab

(10) Patent No.: US 8,122,733 B2
(45) Date of Patent: Feb. 28, 2012

(54) COMPRESSOR ARRANGEMENT

(75) Inventor: Alfred Raab, Hüttlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 782 days.

(21) Appl. No.: 12/225,949

(22) PCT Filed: Mar. 14, 2007

(86) PCT No.: PCT/EP2007/052400

§ 371 (c)(1),
(2), (4) Date: Oct. 3, 2008

(87) PCT Pub. No.: WO2007/115888

PCT Pub. Date: Oct. 18, 2007

(65) Prior Publication Data

US 2009/0056362 A1 Mar. 5, 2009

(30) Foreign Application Priority Data

Apr. 5, 2006 (DE) ..... 20 2006 005 552 U

(51) Int. Cl.
*F25D 23/00* (2006.01)

(52) U.S. Cl. ..... 62/302; 62/382

(58) Field of Classification Search ..... 62/302, 62/382, 285, 291, 259.1, 288; 312/261, 334.29
See application file for complete search history.

(56) References Cited

U.S. PATENT DOCUMENTS

| | | | | | |
|---|---|---|---|---|---|
| 4,490,990 | A | * | 1/1985 | Chastine et al. | 62/279 |
| 4,490,992 | A | * | 1/1985 | Chastine | 62/295 |
| 4,714,304 | A | * | 12/1987 | Sisk et al. | 312/406.2 |
| 4,783,971 | A | * | 11/1988 | Alba | 62/291 |
| 5,499,514 | A | * | 3/1996 | Ho | 62/291 |
| 5,699,677 | A | * | 12/1997 | Hakala et al. | 62/291 |
| 5,881,566 | A | * | 3/1999 | Shacklock et al. | 62/277 |
| 6,094,934 | A | * | 8/2000 | Rand et al. | 62/440 |
| 6,460,955 | B1 | * | 10/2002 | Vaughan et al. | 312/401 |

FOREIGN PATENT DOCUMENTS

| | | | |
|---|---|---|---|
| JP | 6-147734 | | 5/1994 |
| JP | 7-294101 | | 11/1995 |
| JP | 10062059 | A * | 3/1998 |
| WO | WO 2004/003443 | | 1/2004 |

OTHER PUBLICATIONS

Absrtract of JP 10062059 A to Okemoto, Yasuhito.*
International Search Report PCT/EP2007/052400.

* cited by examiner

*Primary Examiner* — Mohammad Ali
(74) *Attorney, Agent, or Firm* — James E. Howard; Andre Pallapies

(57) ABSTRACT

A compressor arrangement comprises a mounting, an evaporation trough, which may be inserted in the mounting on a number of slide-in tracks up to a final position and a compressor, wherein the separation of the evaporation trough from the compressor is greater in the final position of each slide-in track than at least one other point on the slide-in track.

16 Claims, 9 Drawing Sheets

COMPRESSOR ARRANGEMENT

BACKGROUND OF THE INVENTION

The present invention relates to a compressor arrangement comprising a mounting, an evaporation trough, which can be inserted in the mounting on a plurality of slide-in tracks at different heights, as far as a final position, and a compressor. A compressor arrangement of this type for a refrigeration device is disclosed by DE 102 28 739 A1.

In refrigeration devices, moisture which is released from the goods to be cooled to the air in the storage chamber of the refrigeration device or is carried in by opening the door, condenses at the evaporator. In order to conduct away this moisture, a discharge channel or bowl is conventionally provided beneath the evaporator to catch the condensation water flowing off the evaporator. The condensation water is conventionally conducted away from the discharge channel or bowl through a channel to the outside into an evaporation trough. This evaporation trough is conventionally arranged over the compressor of the refrigeration device, so that the condensation water is warmed by the waste heat from the compressor and its evaporation is thereby accelerated.

In order to avoid the evaporation trough overflowing and condensation water reaching current-carrying components of the refrigeration device, a sufficient evaporation performance must be achieved. In order to achieve the greatest possible evaporation performance, it is useful to arrange the evaporation trough as closely as possible over the compressor. The evaporation trough and the compressor should not touch one another, since otherwise the evaporation trough forms a sounding board which amplifies the noises from the compressor.

Since it is advantageous, in serial production of refrigeration devices, to be able to mount different compressor types in the same refrigeration device model, the mounting height of the evaporation trough should be adjustable to the height of the respective compressor.

In the case of the compressor arrangement known from DE 102 28 739 A1, a plurality of holders for the evaporation trough is provided at different heights in the housing. The evaporation trough is constructed drawer-like and is placed with its webs on a suitable holder and then pushed into the housing.

In order to ensure that the evaporation trough is mounted at a suitable height, it is proposed therein to provide the holders with different codings which only allow mounting of the evaporation trough, which is also coded, in the holder whose coding is complementary to that of the evaporation trough. As the coding, a position peg is arranged on the evaporation trough, said position peg being attached to the evaporation trough depending on the compressor model to be mounted, such that the trough is mounted on the correspondingly coded holder.

It is disadvantageous therein, however, that for each compressor type used, suitably coded evaporation troughs have to be provided. An evaporation trough that is not suitably coded for the compressor cannot be mounted at the right distance over the compressor.

BRIEF SUMMARY OF THE INVENTION

It is therefore an object of the present invention to provide a compressor arrangement wherein the same type of evaporation trough can be used for several different compressor types which, nevertheless, enables both effective heating of the evaporation trough and operation of the compressor without amplifying its sounds.

This object is achieved through the claims in that a compressor arrangement with a mounting, an evaporation trough which can be pushed into the mounting as far as a final position on a plurality of slide-in tracks at different heights, and a compressor are provided, wherein the separation of the evaporation trough from the compressor is greater in the final position of each slide-in track than at least one other point on the slide-in track. This design ensures that the evaporation trough and the compressor never touch one another when the evaporation trough is in the final position. A slide-in track on which the evaporation trough comes too close to the compressor is not usable, since on such a track, the trough collides with the compressor and is blocked before it reaches the final position.

Advantageously, a stop is provided on the mounting, against which stop the evaporation trough lies in the final position. A fitter thereby receives unambiguous feedback that the final position has been reached.

It is suitable if the point at which the evaporation trough and the compressor have their smallest separation from one another is at the start of the slide-in track. By this means it is prevented that during mounting the evaporation trough is pushed into slide-in tracks in which it cannot be pushed through to the end.

Particularly easy assembly is achieved if first elements of a tongue and groove connection are arranged at the evaporation trough, said first elements being so configured that they can be brought into engagement with second elements of a tongue and groove connection, said second elements defining the slide-in path.

In a preferred embodiment of the invention, the first elements of the tongue and groove connection are arranged in a central region of the evaporation trough relative to its width. Here, the insertion of the evaporation trough into the mounting is simplified, since slight tilting of the evaporation trough has little effect on the position of the elements of the tongue and groove connection to one another.

Advantageously, the first elements of the tongue and groove connection are provided in a region of the evaporation trough projecting from the upper side of the evaporation trough. The evaporation trough can therefore be hung in the tongue and groove connection.

Suitably, the first elements of the tongue and groove connection are arranged on opposing sides of a vertical line running through the centre of gravity of the evaporation trough. Therefore, in the hanging condition, tilting of the evaporation trough by its own weight is avoided.

The second elements of the tongue and groove connection are preferably multiply provided. This enables hanging of the evaporation trough at different heights.

Suitably, the second elements of the tongue and groove connection are provided on the mounting.

In one embodiment of the invention, in a section parallel to the insertion direction, the compressor has an upper summit point and the evaporation trough has a lower summit point and at the point of at least one slide-in track at which the evaporation trough and the compressor have the smallest separation from one another, the summit points lie one upon the other. By this means, the lower summit point of the evaporation trough is separated from the compressor in the final position. The slide-in tracks on the mounting can be provided horizontal here.

Suitably, the lower summit point is formed by a rib.

In another embodiment of the invention, the slide-in track is not at right angles to the separation vector between the evaporation trough and the compressor at the point at which both have the smallest separation from one another. As a result, the evaporation trough can be guided independently of the form of its underside such that in its mounted condition, it is spaced apart from the compressor.

In another embodiment of the invention, a tongue and groove connection comprises tongues and grooves running transversely to the slide-in track, between the mounting and the evaporation trough. The evaporation trough is also oriented and held by means of the engagement of the tongues and grooves in one another, which is useful particularly if, due to its having a flat configuration and a small wall thickness, said evaporation trough has a low torsional stiffness.

In another embodiment of the invention, the penetration depth of the tongue in the groove varies along the groove. This facilitates insertion of the tongue into the groove.

In a preferred embodiment of the invention, a spring presses the evaporation trough in the direction of the compressor.

In advantageous manner, the evaporation trough is connected to the mounting by frictional engagement in the inserted condition. On insertion, slipping of the evaporation trough out of the slide-in track is prevented if the force acting on the trough during insertion is reduced.

BRIEF DESCRIPTION OF THE DRAWINGS

Further features and advantages of the invention are disclosed in the following description of exemplary embodiments, making reference to the drawings, in which.

DETAILED DESCRIPTION OF THE PRESENT INVENTION

Figure 1:
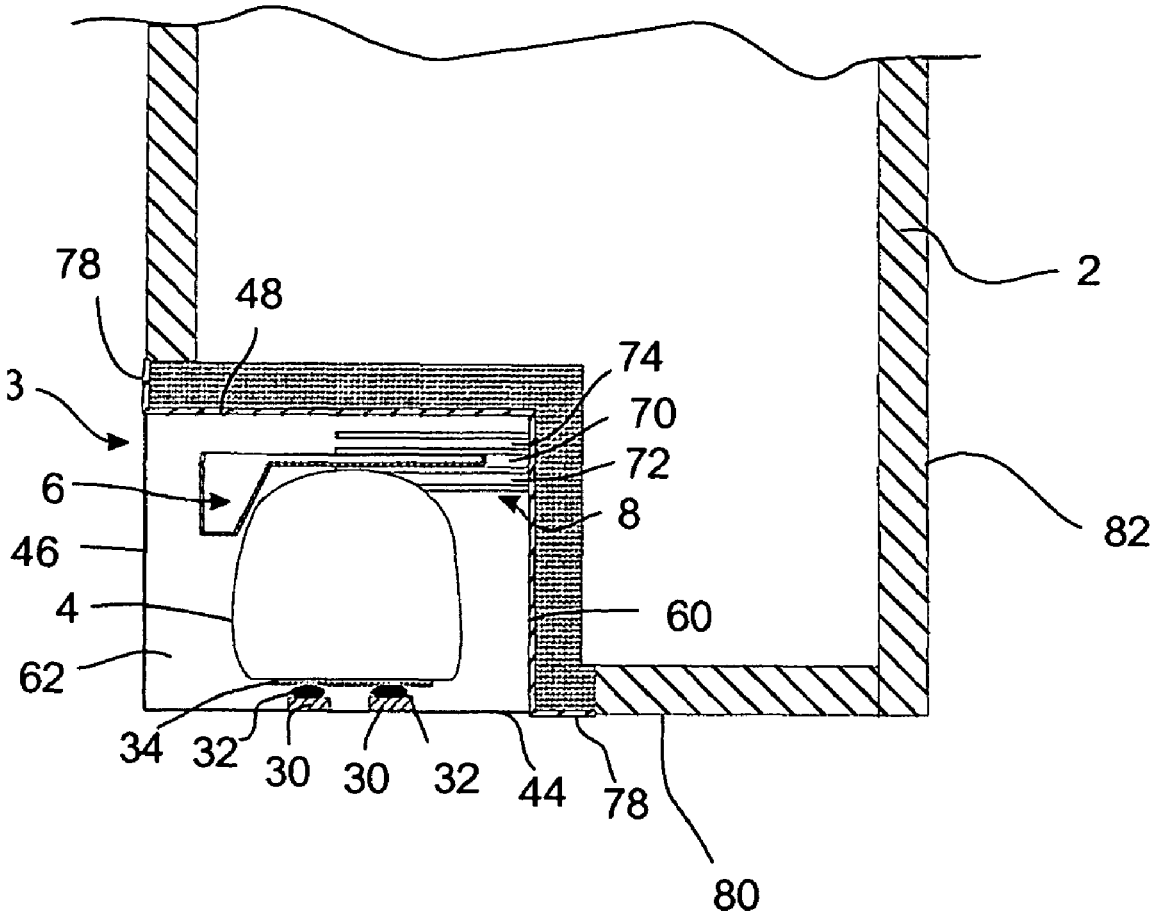
FIG. 1 shows a schematic section through part of a refrigeration device according to the invention.

The refrigeration device shown schematically in section in FIG. 1 comprises a housing 2 with a niche 3 which is open towards an underside 80 and a rear side 82 of the refrigeration device. The niche 3 is delimited by side walls 62, a front wall 60 and the upper wall 48, which together are denoted as the mounting 8. Towards the open rear side 46 and the open underside 44 of the mounting 8, the side walls 62, the front wall 60 and an upper wall 48 each have a peripheral web 78 which is angled outwardly by 90° in each case. Three parallel guide grooves 70, 72, 74 extend horizontally at the side walls 62. Fastened at the side walls 62 are two support beams 30, which each extend from one side wall 62 to the other side wall 62. Fastened to the support beams 30 are rubber buffers 32 on which, in turn, a fixing plate 34 is mounted. Fastened to the fixing plate 34 is a compressor 4. An evaporation trough 6 is introduced into the middle groove 70 of the three parallel guide grooves 70, 72, 74. The lower groove 72 of the three parallel guide grooves 70, 72, 74 is covered by the compressor 4. Therefore, the evaporation trough 6 cannot be introduced here. The upper groove 74 of the three parallel guide grooves 70, 72, 74 is arranged very high above the compressor 4. If the evaporator trough 6 were inserted here, it would be spaced further than necessary from the compressor 4. Since, as a result, the evaporation performance of the evaporation trough 6 would be unnecessarily reduced, the evaporation trough 6 is introduced into the lowest possible guide groove 70.

Figure 2:
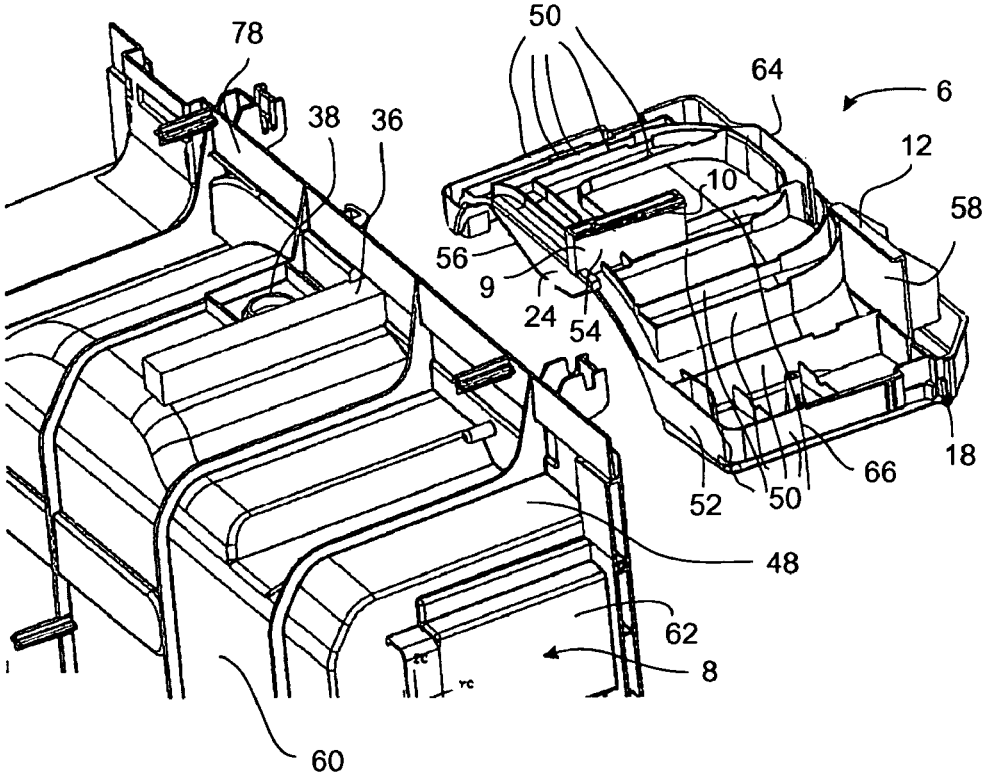
FIG. 2 shows a perspective view of an evaporation trough and a mounting for fastening the evaporation trough.
Figure 3:
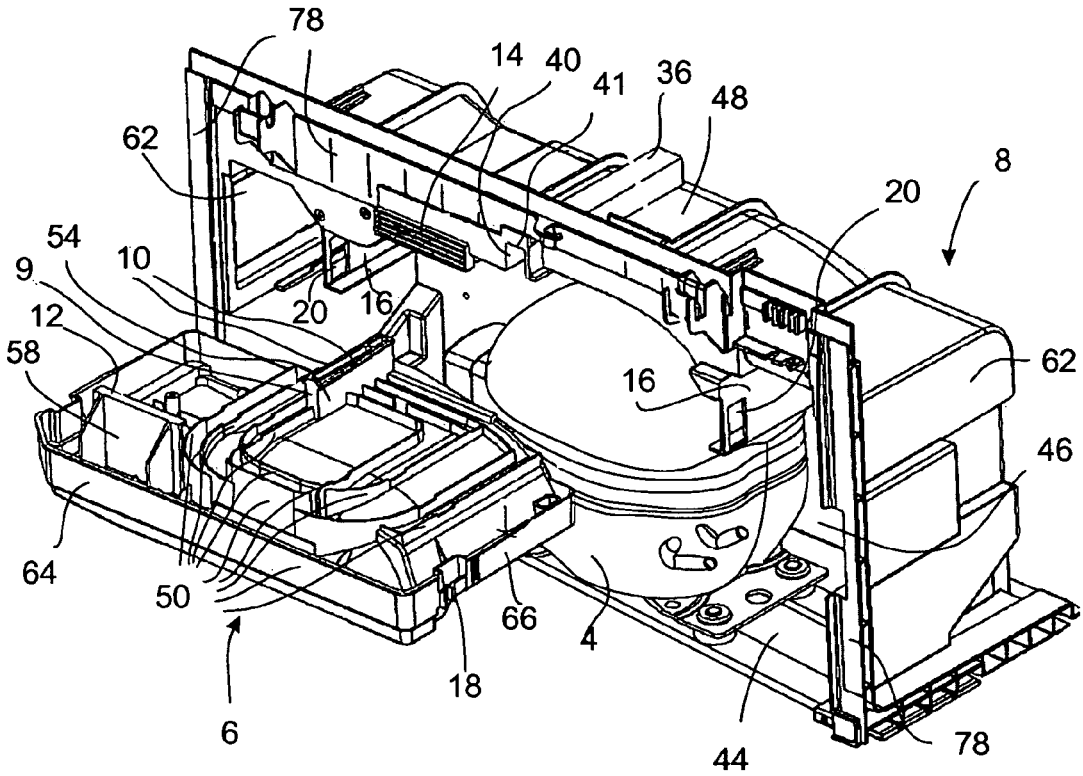
FIG. 3 shows a perspective view of the evaporation trough and the mounting of FIG. 1, seen from a different viewing angle such that the compressor is also shown.
Figure 4:
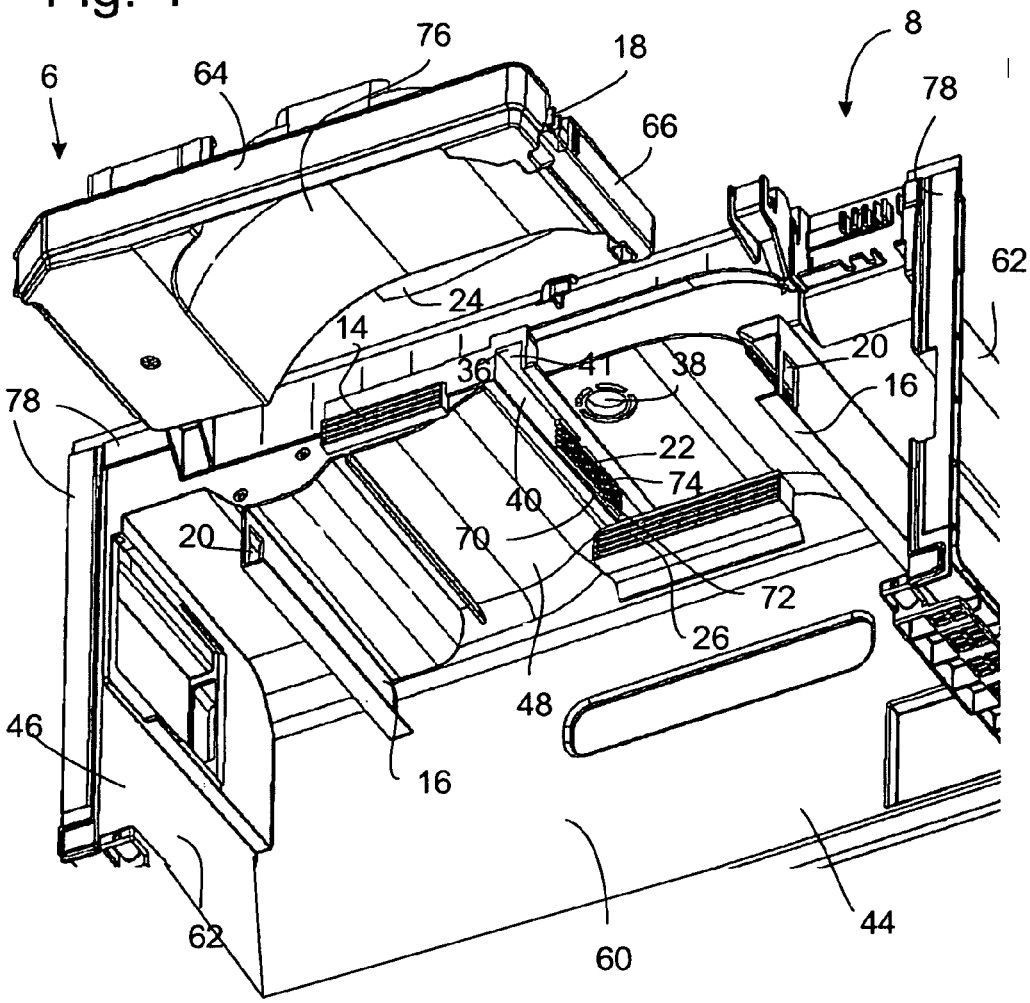
FIG. 4 shows a perspective view of the evaporation trough and the mounting of FIG. 1 from obliquely beneath.

FIGS. 2 to 4 show a second embodiment of the invention. Corresponding components are given the same reference signs as in FIG. 1 and will not be described again. FIGS. 2 to 4 will be described together, since they show essentially the same components from different viewing angles. The mounting 8 has an upward convexity 36 in its upper wall 48, said convexity 36 being elongated in the depth direction. The convexity 36 is open toward an internal space of the mounting 8 and opens onto the peripheral web 78. Arranged in the convexity 36 is a plurality of guide grooves 70, 72, 74 arranged in two mutually opposing groove groups 22 and rising slightly toward the front wall 60 of the mounting 8. Provided at the upper side 48 of the mounting 8, adjacent to the convexity 36, is a discharge opening 38 which forms the opening of a discharge channel coming from the interior of the housing 2. Provided at the peripheral web 78 of the mounting 8, adjacent to the mouth of the convexity 36 are first parallel stabilizing grooves 14. Provided at the inside of the front wall 60 of the mounting 8 at approximately the height of the first parallel stabilizing grooves 14 are second parallel stabilizing grooves 26, forming a stop member. Arranged parallel to the side walls 62 of the mounting 8 are two parallel guide rails 16. In a region of each of the guide rails 16 adjacent to the open rear side 46 is a rectangular locking opening 20.

Also shown in FIGS. 2 to 4 is an evaporation trough 6. The evaporation trough 6 has an upwardly convex base section 76, the convexity of which approximately corresponds to the convexity of the upper side of the compressor 4. The evaporation trough 6 also has side walls 66, a front wall 52 and a rear wall 64. The evaporation trough 6 is subdivided into several reservoirs by a plurality of webs 50. An upright column 9 with a base outline which is elongated in the depth direction extends between the reservoirs from the front wall 52 in the direction toward the rear wall 64. The column 9 has a rib 10 on each of two mutually opposing longitudinal sides 54. These ribs 10 extend along the entire longitudinal sides 54 and rise toward the front wall 52.

Extending vertically upwardly adjacent to the rear wall 64 from one of the webs 50 is a spacing member 58. The spacing member 58 runs parallel to the rear wall 64. It extends over approximately one third of the width of the evaporation trough 6. The upper end of the spacing member 58 is bent over at an angle of 90° to the rear wall 52 of the evaporation trough 6. The upper end thus forms a first stabilizing rib 12.

Also provided at the front wall 52 of the evaporation trough 6 is a second horizontally projecting stabilizing rib 24. A front edge 56 of the second stabilizing rib 24 is beveled towards both ends.

Locking clips 18 are provided at the side walls 66 of the evaporation trough 6. These locking clips 18 are configured springy and, in their unloaded condition, extend beyond the side walls 66.

FIGS. 3 and 4 show where the compressor 4 is arranged within the mounting 8 and how the evaporation trough 6 can be inserted into the mounting 8. The evaporation trough 6 is inserted with its side walls 66 into the guide rails 16 and with the column 9 into the convexity 36 of the mounting 8. When the evaporation trough 6 is pushed approximately half way into the mounting 8 the guide ribs 10 each engage in one of the guide grooves 70, 72, 74 of the two groove groups 22. How the evaporation trough 6 is guided in these guide grooves 70, 72, 74 will be described now by reference to the attached drawings. In the final position of the evaporation trough 6, the first stabilizing rib 12 engages in one of the first parallel stabilizing grooves 14 and the second stabilizing rib 24 engages in one of the second parallel stabilizing grooves 26. The uppermost reservoir of the evaporation trough 6 lies under the discharge opening 38 of the mounting 8, so that condensation water can flow through the discharge opening 38 into the upper reservoir. When the reservoir is full, the condensation water flows through a slot in the web 50 surrounding the reservoir into a deeper lying reservoir.

Figure 5:
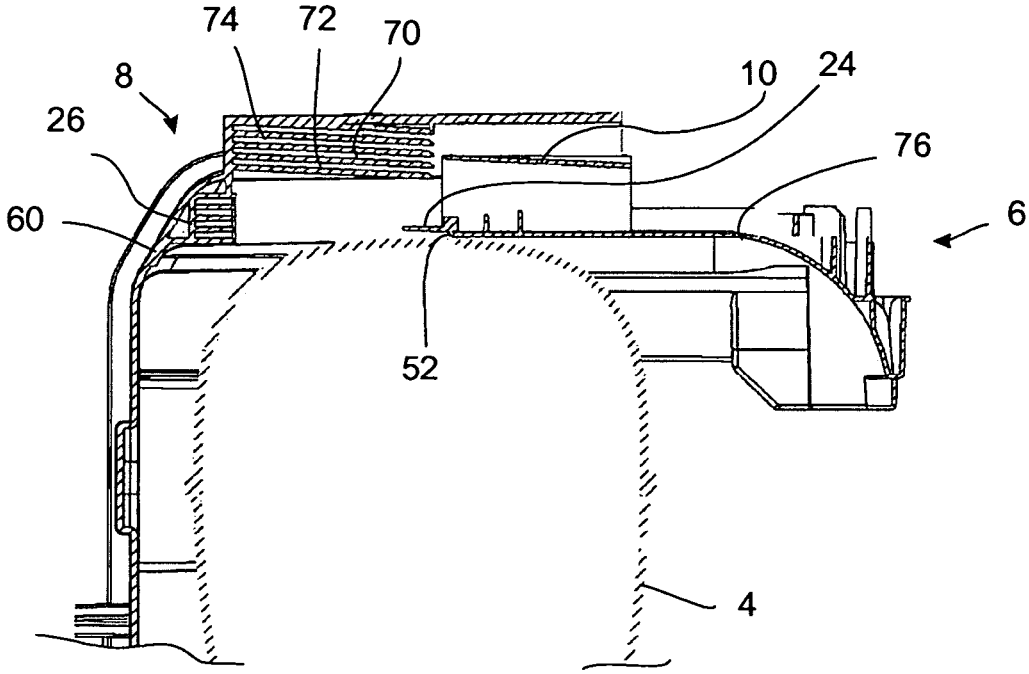
FIG. 5 shows a section through the evaporation trough, the mounting and the compressor shown in FIGS. 2 to 4.
Figure 6:
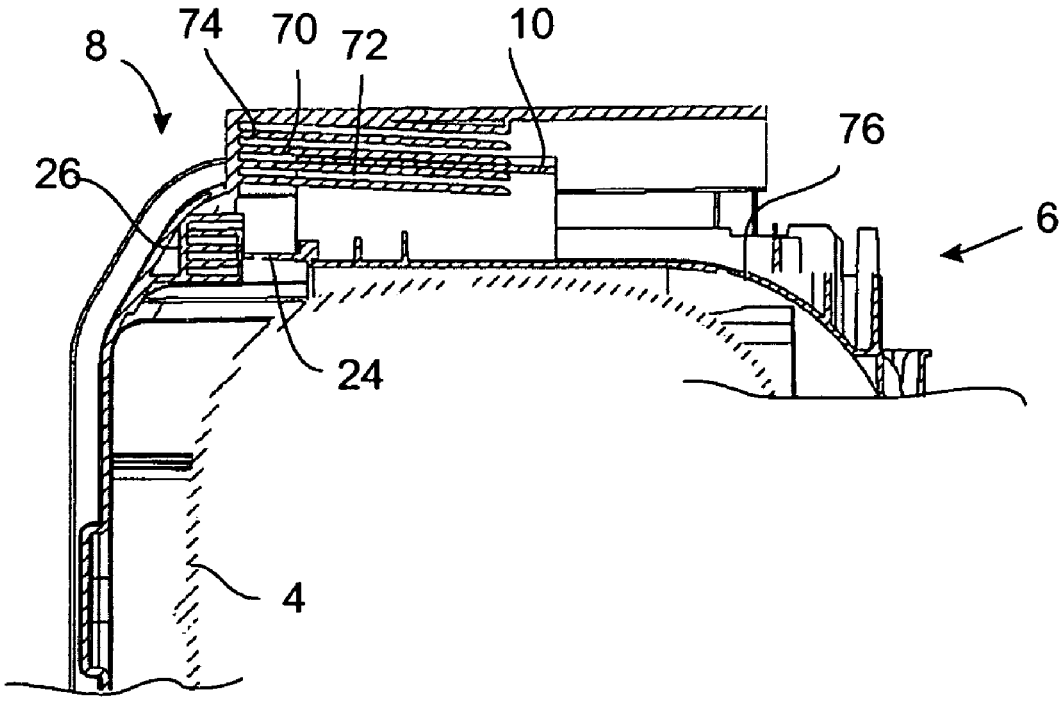
FIG. 6 shows a section through the evaporation trough, the mounting and the compressor shown in FIGS. 2 to 4 in another assembled condition.
Figure 7:
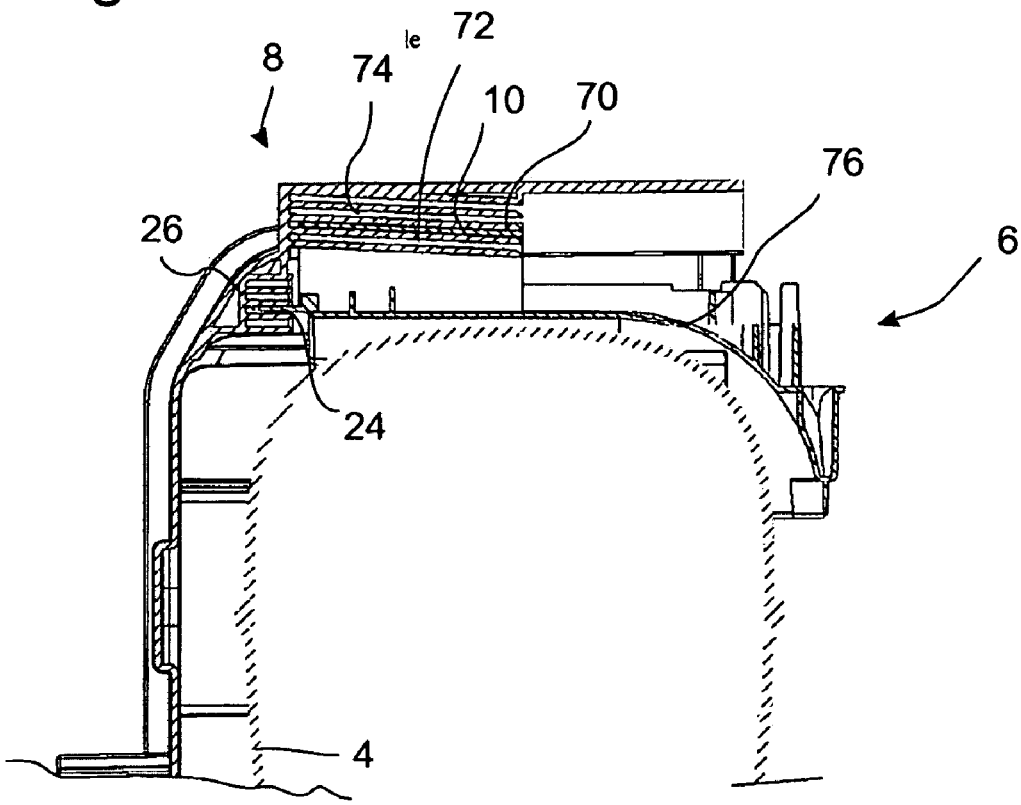
FIG. 7 shows a section through the evaporation trough, the mounting and the compressor shown in FIGS. 2 to 4 in another assembled condition.

FIGS. 5 to 7 show sections through the evaporation trough 6, the mounting 8 and the compressor 4 of FIGS. 2 to 4, in sequential phases of the installation in the evaporation trough 6 in the mounting 8. In FIG. 5, the front wall 52 of the evaporation trough 6 lies on the compressor 4. The rib 10 of the evaporation trough 6 is situated immediately in front of the guide groove 70. The guide groove 72 is arranged beneath the groove 70. It lies so close to the compressor 4 that the rib 10 cannot be inserted therein. The guide groove 74 is arranged above the groove 70. If the rib 10 is inserted herein, the distance between the evaporation trough 6 and the compressor 4 is greater than necessary, so that the evaporation performance of the evaporation trough 6 is reduced unnecessarily. The guide groove 74 is provided for the event that a compressor 4 which has a higher summit point than the compressor 4 shown in FIG. 5 is installed. In this view, it is clearly apparent that the guide grooves 70, 72, 74 are configured rising toward the rear wall 60. This has the result that, on insertion, the evaporation trough 6 is raised so that, in its final position, it is spaced apart from the compressor 4.

FIG. 6 shows a further section through the evaporation trough 6, the mounting 8 and the compressor 4. The rib 10 is inserted approximately two-thirds of the way into the groove 70.

Since the parallel guide grooves 70, 72, 74 rise toward the rear wall 60, the evaporation trough 6 is raised during insertion so that all regions of the evaporation trough 6 are spaced apart from the compressor 4. The second stabilizing rib 24 is situated just in front of the second group of parallel stabilizing grooves 26. Since the second stabilizing rib 24 is inclined, on insertion into one of the second stabilizing grooves 26, it is initially inserted with only a small part. Any error of parallelism between the stabilizing grooves 26 and the stabilizing rib 24 therefore does not prevent said stabilizing rib 24 from entering one of the grooves 26. The deeper the rib 24 penetrates the groove 26, the broader the engagement region between them becomes and the groove and the rib automatically orient themselves parallel to one another. Introduction of the rib 24 into the groove 26 is thereby facilitated.

FIG. 7 shows a section through the evaporation trough 6, the mounting 8 and the compressor 4 in the assembled condition. The rib 10 is fully accommodated in the guide groove 70 and the second stabilizing rib 24 is situated fully in one of the second parallel stabilizing grooves 26. The locking clips 18 (not shown in this drawing) are latched into the locking openings 20 (also not shown). The evaporation trough 6 is spaced apart from the compressor 4 in all regions. The base section 76 of the evaporation trough 6 arches over the upper side of the compressor 4. This further optimizes the heating of the evaporation trough 6.

Figure 8:
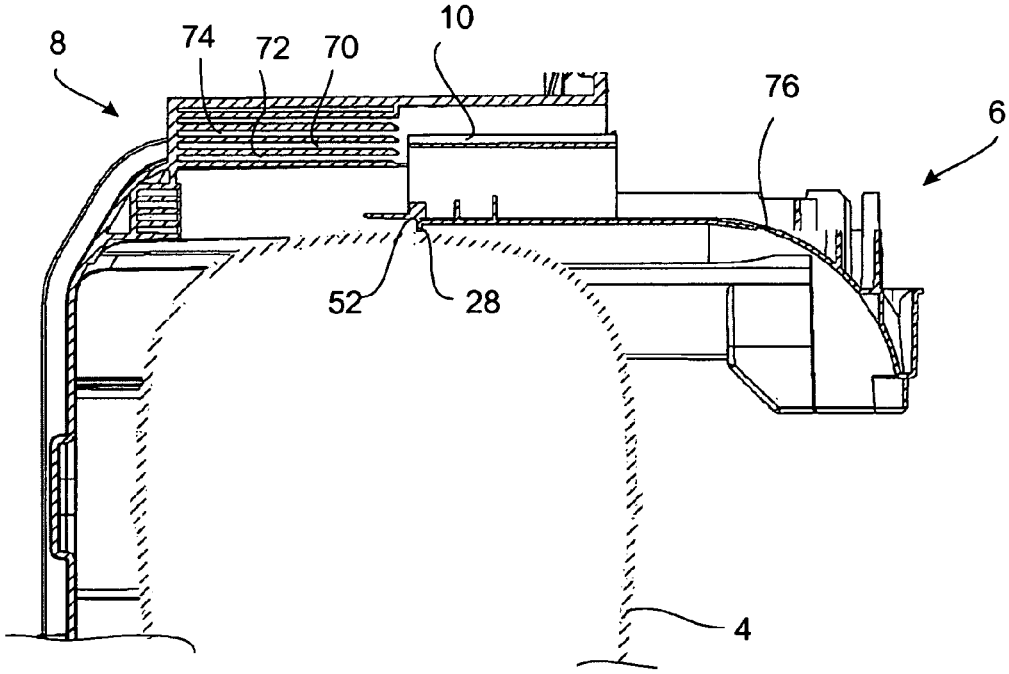
FIG. 8 shows a section through an evaporation trough, a mounting and a compressor in another embodiment.

FIG. 8 shows a section through an evaporation trough 6, a mounting 8 and a compressor 4 in another embodiment of the first assembly phase. As distinct from the embodiment shown in FIGS. 2 to 7, the parallel guide grooves 70, 72, 74 are arranged horizontally here. The front wall 52 of the evaporation trough 6 extends downwardly beyond the arched base section 76 and thereby forms a downwardly extending spacing rib 28. In the first assembly phase shown, the spacing rib 28 lies on the summit point of the compressor 4. The guide rib 10 is situated directly in front of the guide grooves 70. If the evaporation trough 6 is inserted further into the mounting 8 in the subsequent assembly steps, the guide rib 10 engages in one of the parallel guide grooves 70, 72, 74 and holds the evaporation trough 6 at the initially set height. On further insertion of the evaporation trough 6 into the mounting 8, an air gap is formed between the spacing rib 28 and the compressor 4.

Figure 9:
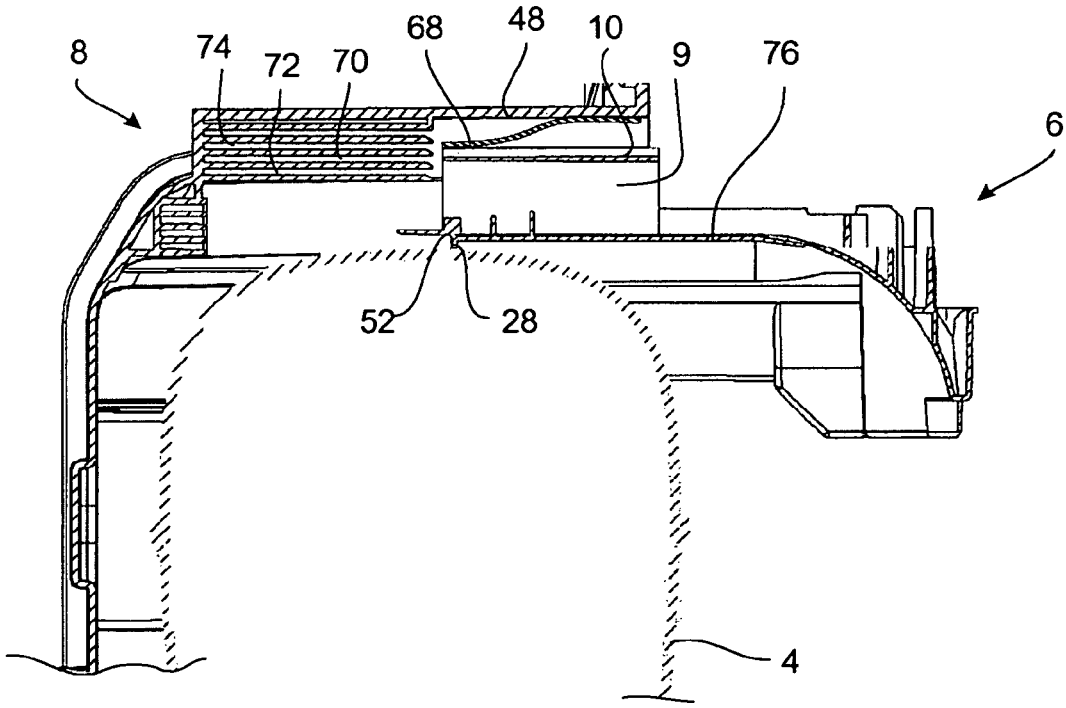
FIG. 9 shows a section through an evaporation trough, a mounting and a compressor in another embodiment.

FIG. 9 shows a section through an evaporation trough 6, a mounting 8 and a compressor 4 in another embodiment in the first assembly phase. As distinct from the above described embodiments, a leaf spring 68 is mounted on the column 9 of the evaporation trough 6, said leaf spring 68 resting against the upper wall 48 of the mounting 8 during assembly and becoming tensioned thereby. The force which is thereby exerted on the upper side of the column 9 presses the evaporation trough 6 in the direction of the compressor 4. The leaf spring 68 makes it difficult for a fitter to insert the evaporation trough 6 into any other than the lowest possible guide groove 70.

The invention claimed is:

1. A compressor arrangement comprising a mounting assembly having a plurality of slide-in tracks formed as a plurality of longitudinally extending guide grooves arranged in a spaced vertical array, an evaporation trough configured for insertion in the mounting assembly on said plurality of slide-in tracks at different heights in the spaced vertical array including a final position, and a compressor, wherein the separation of the evaporation trough from the compressor is greater in the final position of each slide-in track than an insertion point on the slide-in track.

2. The compressor arrangement according to claim 1 wherein the mounting assembly includes a stop member, against which the evaporation trough lies in the final position.

3. The compressor arrangement according to claim 1 wherein the point at which the evaporation trough and the compressor have their smallest separation from one another is at the start of the slide-in track.

4. The compressor arrangement according to claim 1 and further comprising first elements of a tongue-and-groove connection and second elements of a tongue-and-groove connection, said first elements being a plurality of ribs arranged at the evaporation trough and so configured that they can be brought into engagement with said second elements, with said second elements being the guide grooves.

5. The compressor arrangement according to claim 1 and further comprising first elements of a tongue-and-groove connection arranged in a central region of the evaporation trough relative to the width of the evaporation trough.

6. The compressor arrangement according to claim 1 and further comprising first elements of a tongue-and-groove connection provided in a region of the evaporation trough projecting from the upper side of the evaporation trough.

7. The compressor arrangement according to claim 1 and further comprising first elements of a tongue-and-groove connection arranged on opposing sides of a vertical line running through the center of gravity of the evaporation trough.

8. The compressor arrangement according to claim 7 and further comprising a plurality of second elements of a tongue-and-groove connection.

9. The compressor arrangement according to claim 1 and further comprising second elements of the tongue-and-groove connection provided on the mounting assembly.

10. The compressor arrangement according to claim 1 wherein the slide-in track is not at right angles to a separation vector between the evaporation trough and the compressor at the point at which both have the smallest separation from one another.

11. The compressor arrangement according to claim 1 wherein a tongue-and-groove connection comprises ribs and grooves running transversely to the slide-in track, disposed between the mounting and the evaporation trough.

12. The compressor arrangement according to claim 11 wherein a penetration depth of at least one rib in a groove varies along the groove.

13. The compressor arrangement according to claim 1 and further comprising a spring configured for urging the evaporation trough in the direction of the compressor.

14. The compressor arrangement according to claim 1 wherein the evaporation trough is connected to the mounting assembly by frictional engagement in the inserted condition.

15. A compressor arrangement comprising a mounting assembly having a plurality of guide grooves, an evaporation trough configured for insertion in the mounting assembly on said plurality of guide grooves at different heights including a final position, and a compressor, wherein the separation of the evaporation trough from the compressor is greater in the final position of each guide groove than at least one other point on the guide groove, wherein in a section parallel to the insertion direction, the compressor has an upper summit point and the evaporation trough has a lower summit point and at the point of at least one of the guide grooves at which the evaporation trough and the compressor have the smallest separation from one another, the summit points lie one upon the other.

16. The compressor arrangement according to claim 15, wherein the lower summit point is formed by a rib.

* * * * *